United States Patent [19]

Kubota et al.

[11] Patent Number: 4,793,596

[45] Date of Patent: Dec. 27, 1988

[54] APPARATUS FOR AND A METHOD OF RAPIDLY DISCHARGING A MOLTEN METAL FROM ITS SUPPLY SYSTEM OF A PRESSURIZED HOLDING FURNACE

[75] Inventors: Shoko Kubota; Sadayoshi Yamada, both of Zama, Japan

[73] Assignee: Toshiba Machine Co., Ltd., Tokyo, Japan

[21] Appl. No.: 119,154

[22] Filed: Nov. 10, 1987

[30] Foreign Application Priority Data

Nov. 10, 1986 [JP] Japan ..... 61-265567

[51] Int. Cl.[4] ..... C21B 13/00

[52] U.S. Cl. ..... 266/44; 75/61; 266/239

[58] Field of Search ..... 75/61; 266/44, 239

[56] References Cited

U.S. PATENT DOCUMENTS 3,814,167 6/1974 Listhuber ..... 75/61

4,427,444 1/1984 Sumida ..... 75/61

*Primary Examiner*—Peter D. Rosenberg

*Attorney, Agent, or Firm*—Robert R. Jackson

[57] ABSTRACT

A method of rapidly discharging a molten metal from its supply system of a pressurized holding furnace having an open feeding chamber provided at one side of a pressure chamber with a suction pipe of a delivery pump, said pressure chamber having an inlet valve and an outlet valve for a pressure gas, in which the pressure chamber is pressurized to keep a constant level of the molten metal in the feeding chamber for maintaining a constant suction head of the delivery pump is disclosed, wherein the suction pipe is situated at a higher position than such a level of the molten metal in the feeding chamber that is lowered when a pressure in the pressure chamber is released while the supply system including the delivery pump is positioned upwardly above the suction pipe, and in that the outlet valve of the pressure chamber is opened when the molten metal is discharged from the supply system for allowing the molten metal to return into the pressure chamber, thereby rapidly lowering the metal level of the feeding chamber below the suction pipe for discharging the molten metal from the supply system into the holding furnace.

2 Claims, 1 Drawing Sheet

APPARATUS FOR AND A METHOD OF RAPIDLY DISCHARGING A MOLTEN METAL FROM ITS SUPPLY SYSTEM OF A PRESSURIZED HOLDING FURNACE

FIELD OF THE INVENTION

This invention relates to a method of rapidly discharging a molten metal from its supply system of a holding furnace for storing the molten metal to be fed into a die-cast machine, especially of a pressurized holding furnace having an open feeding chamber and capable of keeping a constant level of the molten metal in the feeding chamber.

BACKGROUND OF THE INVENTION

As a holding furnace for the molten metal to be used for a die-cast machine, there has generally been utilized either an open type holding furnace with its upper portion being open to the atmosphere or a pressure type holding furnace with its inside being hermetic. In such conventional holding furnaces, the former one has advantages of a simple structure and convenient maintenance but is accomplished with a disadvantage of an uncertain feeding amount of the molten metal due to a level decrease over the feeding period, while the latter one is accompanied with disadvantages of a complicated structure and inferior maintenance but has an advantage of a stable feeding amount of the molten metal.

In the die-casting art, it is essential to keep the feeding amount of the molten metal at a constant in order to improve the quality of castings and the efficiency of operation. Consequently, the pressure type holding furnace has generally been employed in spite of its disadvantages as described hereinabove. In view of this fact, the holding furnace of such a type has recently been developed that comprises a feeding chamber of the molten metal with its portion being open to the atmosphere without necessity of entirely sealing the furnace for solving the problems of the pressure type holding furnace, as previously described.

Figure 2:
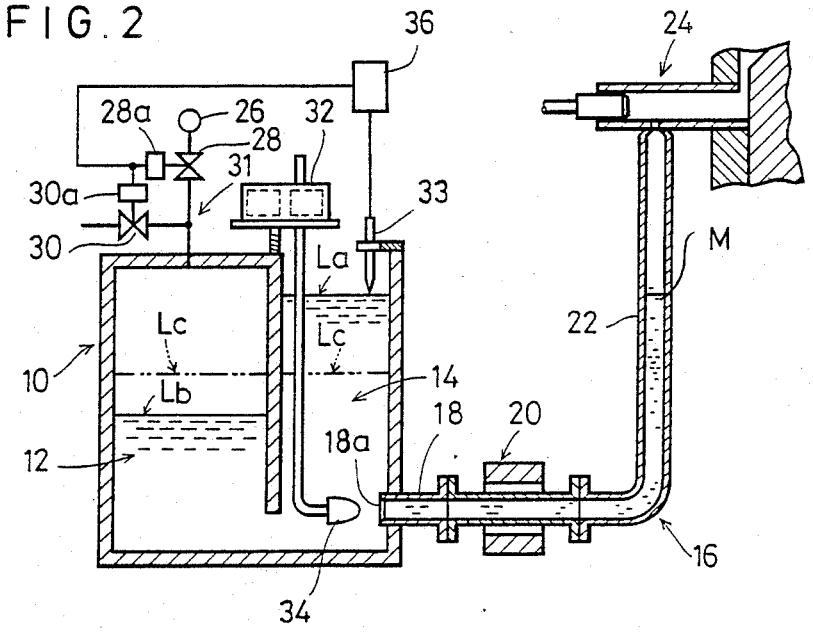

Such pressure type holding furnace having the open feeding chamber is shown in FIG. 2 of the accompanying drawings, in which a holding furnace 10 is divided into a closed pressure chamber 12 and an open feeding chamber 14. The feeding chamber 14 at its lower side wall is connected with a suction pipe 18 forming a supply system 16 of the molten metal M. The suction pipe 18 is provided with an electromagnetic pump 20 for a force feed system and is connected to a die-cast machine through a riser delivery pipe 22. The pressure chamber 12 at its upper portion is provided with a supply/discharge system 31 which is communicated with a compressed gas source 26 through an inlet valve 28 and with the atmosphere through an outlet valve 30. The feeding chamber 14 at its inside, on the other hand, is provided with a level detector 33 for detecting a level La of the molten metal as well as with a closing plug 34 and its actuating means 32 for selectively closing and opening a mouth 18*a* of the suction pipe 18. Further, the inlet and outlet valves 28 and 30 are operated by drive means 28*a* and 30*a* which in turn are connected to a valve operating device 36 for receiving a detected signal from the level detector 33 and generating an instruction signal to each valve for its opening and closing operation.

In the construction described above, when the molten metal M is supplied by the electromagnetic pump 20 to the die-cast machine 24, the level of the feeding chamber 14 has a tendency to decrease below the set level La which, however, is detected by the level detector 33 to enable the valve operating device 36 to open the inlet valve 28, thereby introducing the pressure gas from the compressed gas source 26 into the pressure chamber 12. As a result, the level in the feeding chamber 14 does not lower but is maintained at the set level La, while the level Lb in the pressure chamber 12 decreases when the molten metal M is supplied, as shown with an arrow. When the molten metal M is supplied through a supplementing path (not shown) into the pressure chamber 12, a portion of the molten metal has tendency to flow into the feeding chamber 14, thereby raising the level La. Again in this case, the level detector 33 detects the tendency and enables the outlet valve 30 to open for releasing the pressure from the pressure chamber 12. Thus, the level in the feeding chamber 14 does not rise but is kept at the set level La, while the level Lb in the pressure chamber 12 is raised for keeping the molten metal at the constant set level La in the feeding chamber 14. For this reason, a suction head of the molten metal M on the electromagnetic pump 30 is continuously maintained at constant, thereby continuously keeping the constant amount of the molten metal to be supplied by the electromagnetic pump 30 to the die-cast machine 24.

The pressurized furnace of such type, in comparison with the conventional holding furnace of a hermetic type, may be conveniently constructed with so-called quantitative control equipment for feeding a constant amount of the molten metal to the die-cast machine. Thus, the disadvantages of the hermetical holding furnace may be eliminated.

In the holding furnace for feeding the molten metal, on the other hand, removal of the electromagnetic pump or discharge of the molten metal from the supply system is required for their maintenance. Further, in case of emergency, at least the supply system should be blocked from the holding furnace while the molten metal should be rapidly discharged from the supply system. For this purpose, the pressure type holding furnace shown in FIG. 2 is provided with a plug 34 for blocking the suction mouth 18*a*. Upon emergency, the mouth 18*a* is blocked with the plug 34 by means of a plug-operating device 32 while the outlet valve 30 is opened by the valve operating device 36 for releasing the pressure from the pressure chamber 12. In this case, the level La in the feeding chamber 14 is lowered while the level Lb in the pressure chamber 12 is raised, thereby providing an equilibrium level Lc.

In the holding furnace of such construction, however, at least an amount of the molten metal M corresponding to the level Lc remains in the supply system 16 even when the latter is isolated from the holding furnace 10. As a result, upon emergency of leakage of the molten metal in the vicinity of the electromagnetic pump 20, the leaking molten metal cannot be prevented on the spot while the removal of the electromagnetic pump 20 for maintenance causes the dangerous flowing-out of the residual molten metal. In these cases, the hot molten metal may damge the operation and environment. In order to avoid such risk, the residual hot molten metal M should be scooped externally out of the holding furnace 10, consuming considerable time and cost for the labor.

As described hereinabove, the maintenance of the supply system 16 of the furnace is accompanied with the considerable time and cost for the dangerous work and cannot be properly coped with in case of emergency. In a view-point of the structure, the blocking plug and its operating means are inevitable for the suction pipe, resulting in the complicated structure of the furnace.

Accordingly, an object of the invention is to provide a method of rapidly discharging a molten metal from its supply system of a pressurized holding furnace, which may solve the above problems by utilizing the charactertists of the pressurized holding furnace with the level control of the molten metal and may discharge the molten metal rapidly and completely out of the supply system in case of emergency.

SUMMARY OF THE INVENTION

In order to achieve the above object, the invention provides a method of rapidly discharging a molten metal from its supply system of a pressurized holding furnace having an open feeding chamber provided at one side of a pressure chamber with a suction pipe of a delivery pump, said pressure chamber having an inlet valve and an outlet valve for a pressure gas, in which the pressure chamber is pressurized to keep a constant level of the molten metal in the feeding chamber for maintaining a constant suction head of the delivery pump, characterized in that the suction pipe is situated at a higher position than such a level of the molten metal in the feeding chamber that is lowered when a pressure in the pressure chamber is released while the supply system including the delivery pump is positioned upwardly above the suction pipe, and in that the outlet valve of the pressure chamber is opened when the molten metal is discharged from the supply system for allowing the molten metal to return into the pressure chamber, thereby rapidly lowering the metal level of the feeding chamber below the suction pipe for discharging the molten metal from the supply system into the holding furnace.

When the outlet valve is opened to lower the level of the molten metal in the feeding chamber, the suction mouth is located above the lowered level while the supply system is positioned upwardly above the suction mouth, so that all molten metal in the supply system may be rapidly and surely discharged by its own weight into the holding furnace. Thus, the maintenance of the supply system and the treatment upon emergency may be rapidly and properly achieved.

Further, the location of the suction mouth above the feeding chamber of the molten metal, in comparison with the conventional location below the feeding chamber in the prior art may reduce the suction head of the molten metal on the electromagnetic pump, which is accompanied with a slightly higher power for operating the electromagnetic pump but is not problematical for a principal object of quantitatively controlling the electromagnetic pump.

BRIEF DESCRIPTION OF THE ACCOMPANYING DRAWINGS

Figure 1:
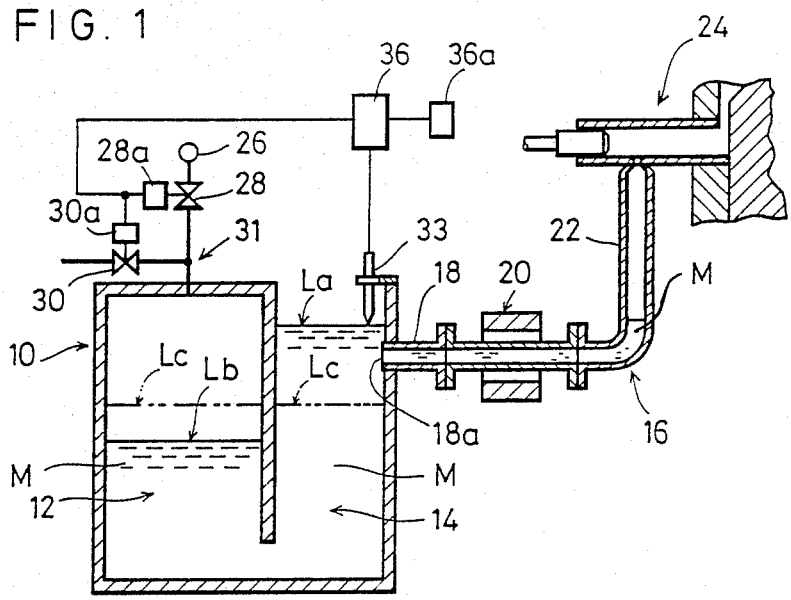

FIG. 1 is a sectional view of one embodiment of a pressurized holding furnace and its supply system of a molten metal for carrying out the method according to the invention; and FIG. 2 is a sectional view of a conventional holding furnace of a pressure type and its supply system of the molten metal in the conventional method.

PREFERRED EMBODIMENTS OF THE INVENTION

The invention will now be described in more detail for better understanding with reference to the accompanying drawings, in which the same elements are represented by the same references as in FIG. 2 and omitted for their detailed description.

FIG. 1 shows one embodiment of the rapidly discharging method according to the invention, which will be described with its construction.

The pressure type holding furnace 10 for the molten metal comprises the closed pressure chamber 12 and the open feeding chamber 14 arranged at one side of the chamber 12. The feeding chamber 14, at its upper side wall, is provided with the suction pipe 18 forming the supply system 16 for the molten metal M. The suction pipe 18 is provided with the electromagnetic pump 20 for the force feeding system and is connected to the die-cast machine 24 through the riser delivery pipe 22. The pressure chamber 12 at its upper portion is connected to the inlet/outlet system 31 which is communicated with the compressed gas source 26 through the inlet valve 28 and with the atmosphere through the outlet valve 30. The feeding chamber 14 is provided therein with the level detector 33 for detecting the set level La of the molten metal M. The level detector 33 generates the detected signal as an instruction signal to the valve operating device 36 for actuating the driving means **28*a* and 30a, thereby opening and closing the inlet and outlet valves 28 and 30. The valve operating device 36 is provided with a discharge-valve operating device 36*a*** useful for the emergency.

The location of the suction pipe 18 at the upper side wall of the feeding chamber 14 is set at a higher position than the level La of the molten metal in the feeding chamber 14, which is lowered when the pressure is released from the pressure chamber 12. Further, a discharging capacity of the outlet valve 30 is determined so as to enable the rapid release of the pressure from the pressure chamber 12.

In accordance with the invention, the location of the suction pipe is displaced from the lower position of the prior art to the upper position of the feeding chamber in the holding furnace of the invention, thereby eliminating the blocking plug 34 in the feeding chamber and its operating means 32.

The supply of the molten metal to the pressurized holding furnace according to the invention may be carried out similarly to the conventional holding furnace shown in FIG. 2. In other words, during the supply of the molten metal M to the die-cast machine 24 by means of the electromagnetic pump 20, the pressure gas is introduced through the inlet valve 28 into the pressure chamber 12, thereby keeping the constant level La in the feeding chamber 14 but lowering the level Lb in the pressure chamber 12. During the supply of the molten metal M to the pressure chamber 12, on the other hand, the pressure gas is discharged through the outlet valve 30 from the pressure chamber 12, thereby keeping the constant level La in the feeding chamber 14 but raising the level Lb in the pressure chamber 12.

The rapid discharging method according to the invention will now be described. For the maintenance of the supply sytem 16 or in case of emergency, the discharge-valve operating device **36*a* is operated, thereby fully opening the outlet valve by means of the valve operating device 36 and the outlet valve drive 30*a* in order to rapidly release the pressure from the pressure chamber 12 for equilibrating the levels both in the pressure chamber 12 and the feeding chamber 14 to the level Lc. Under this equilibrium condition, the suction mouth 18***a* is located above the equilibrated level Lc and the supply means 16 is positioned upwardly above the suction mouth 18*a*, so that the molten metal M in the supply system 16 may be discharged rapidly and surely by its own weight into the feeding chamber 14. Thus, the electromagnetic pump 20 may be safely removed without any trouble of the hot molten metal M while the leakage, if any, from the supply system 16 may be surely prevented on the spot.

In accordance with the rapid discharging method of the invention, the simple operation of releasing the pressure from the pressure chamber 12 enables the molten metal of the supply system 16 to be discharged by its own weight into the feeding chamber surely and rapidly. Further, the supply system 16 is not required to be isolated from the holding furnace 10, so that the operating means 32 and the blocking plug 34 with the complicated mechanism may be eliminated.

As described hereinabove, the method according to the invention enables the molten metal of the supply system to be discharged by its own weight onto the lowered level of the molten metal by the fact that the suction pipe of the supply system is positioned above the lowered level in the feeding chamber when the pressure is released from the pressure chamber. Thus, the simple operation of releasing the pressure from the pressure chamber may discharge the entire molten metal rapidly and completely from the feeding chamber, resulting in the rapid and safe maintenance of the supply system and the treatment upon the emergency. Further, the blocking plug and its operating means for the suction pipe may be eliminated, resulting in the simple construction of the pressure holding furnace.

What is claimed is:

1. A method of rapidly discharging a molten metal from the supply system associated with a pressurized holding furnace which supplies molten metal to the feeding section of a die cast machine, said pressurized furnace including (1) a pressure chamber having an inlet valve and a discharge valve for a pressure gas and (2) an open feeding chamber communicating with said pressure chamber at a level below the level of the molten metal in the pressure chamber, said pressure chamber being pressurizable to maintain a constant molten metal level in said feeding chamber, said supply system including a delivery pump operatively connected between a suction pipe and a delivery pipe, said delivery pipe extending upward from the level of said suction pipe and said delivery pump and being connected adjacent its upper end to the feeding section of said die cast machine which is above the level of molten metal in said feeding chamber. said method comprising the steps of:

connecting the end of said suction pipe remote from said delivery pump to said feeding chamber at a level below the level at which said molten metal is maintained in said feeding chamber when said pressure chamber is pressurized, but above the level to which said molten metal falls in said feeding chamber when said pressure chamber is depressurized;

pressurizing said pressure chamber so that when said delivery pump is not operating, the molten metal level in said supply system is above the level of said delivery pump but below the level of the feeding section of said die cast machine;

operating said delivery pump while said pressure chamber is pressurized to cause the molten metal level in said supply system to rise to the level of the feeding section of said die cast machine; and opening said discharge valve to depressurize said pressure chamber so that the molten metal level in said feeding chamber falls below the level of said end of said suction pipe and the molten metal in said supply system flows back into said feeding chamber.

2. An apparatus for rapidly discharging a molten metal from the supply system associated with a pressurized holding furnace which supplies molten metal to the feeding section of a die cast machine, said pressurized furnace including (1) a pressure chamber having an inlet valve and a discharge valve for a pressure gas and (2) an open feeding chamber communicating with said pressure chamber at a level below the level of the molten metal in the pressure chamber, said pressure chamber being pressurizable to maintain a constant molten metal level in said feeding chamber, said supply system including a delivery pump operatively connected between a suction pipe and a delivery pipe, said delivery pipe extending upward from the level of said suction pipe and said delivery pump and being connected adjacent its upper end to the feeding section of said die cast machine which is above the level of the molten metal in said feeding chamber, said apparatus comprising:

means for connecting the end of said suction pipe remote from said delivery pump to said feeding chamber at a level below the level at which said molten metal is maintained in said feeding chamber when said pressure chamber is pressurized, but above the level to which said molten metal falls in said feeding chamber when said pressure chamber is depressurized so that when said pressure chamber is depressurized and the molten metal level in said feeding chamber consequently falls below the level of said end of said suction pipe, the molten metal in said supply system flows back into said feeding chamber.

* * * * *